US010185272B2

(12) United States Patent
Nakajima

(10) Patent No.: US 10,185,272 B2
(45) Date of Patent: Jan. 22, 2019

(54) IMAGE FORMING APPARATUS

(71) Applicant: FUJI XEROX CO., LTD., Tokyo (JP)

(72) Inventor: Gen Nakajima, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 24 days.

(21) Appl. No.: 15/227,011

(22) Filed: Aug. 3, 2016

(65) Prior Publication Data

US 2017/0269531 A1 Sep. 21, 2017

(30) Foreign Application Priority Data

Mar. 15, 2016 (JP) ..... 2016-051231

(51) Int. Cl.
*G03G 15/00* (2006.01)
*G03G 15/08* (2006.01)
*G03G 21/16* (2006.01)

(52) U.S. Cl.
CPC ..... *G03G 15/6529* (2013.01); *G03G 15/08* (2013.01); *G03G 15/5041* (2013.01); *G03G 15/0886* (2013.01); *G03G 15/5054* (2013.01); *G03G 15/5058* (2013.01); *G03G 21/16* (2013.01); *G03G 2215/00029* (2013.01); *G03G 2215/00037* (2013.01); *G03G 2215/00059* (2013.01); *G03G 2215/00616* (2013.01)

(58) Field of Classification Search
CPC . G03G 15/5041; G03G 21/16; G03G 15/5054
USPC ..... 399/388
See application file for complete search history.

(56) References Cited

U.S. PATENT DOCUMENTS 5,926,682 A * 7/1999 Tomiki ..... G03G 15/165 399/381
2013/0336667 A1* 12/2013 Watanabe ..... G03G 15/6555 399/23

FOREIGN PATENT DOCUMENTS

JP 5-259252 A 10/1993
JP 7-92753 A 4/1995
JP 2009042533 A * 2/2009 ..... G03G 15/0194

* cited by examiner

*Primary Examiner* — Leslie J Evanisko
*Assistant Examiner* — Quang X Nguyen
(74) *Attorney, Agent, or Firm* — Sughrue Mion, PLLC

(57) ABSTRACT

An image forming apparatus includes an image carrier that holds an image, which is formed by developing a latent image and which is transferred onto a recording medium, a developing device that is disposed adjacent to the image carrier and that develops the latent image, a light-reflection-type sensing unit that is disposed below the developing device in a vertical direction and that detects the image on the image carrier, and a guiding member that guides the recording medium, which is transported between the developing device and the sensing unit, and that covers an upper side of the sensing unit in the vertical direction in a state where a space is ensured on an optical path of the sensing unit.

15 Claims, 6 Drawing Sheets

IMAGE FORMING APPARATUS

CROSS-REFERENCE TO RELATED APPLICATIONS

This application is based on and claims priority under 35 USC 119 from Japanese Patent Application No. 2016-051231 filed Mar. 15, 2016.

BACKGROUND (i) Technical Field

The present invention relates to an image forming apparatus.

(ii) Related Art

In a configuration in which a sensing unit is disposed below a developing device, a detection failure of the sensing unit may sometimes be caused by a developer that has fallen from the developing device.

SUMMARY

According to an aspect of the invention, there is provided an image forming apparatus including an image carrier that holds an image, which is formed by developing a latent image and which is to be transferred onto a recording medium, a developing device that is disposed adjacent to the image carrier and that develops the latent image, a light-reflection-type sensing unit that is disposed below the developing device in a vertical direction and that detects the image on the image carrier, and a guiding member that guides the recording medium, which is transported between the developing device and the sensing unit, and that covers an upper side of the sensing unit in the vertical direction in a state where a space is ensured on an optical path of the sensing unit.

BRIEF DESCRIPTION OF THE DRAWINGS

Exemplary embodiments of the present invention will be described in detail based on the following figures, wherein.

DETAILED DESCRIPTION

An exemplary embodiment of the present invention will be described below with reference to the drawings.

(Image Forming Apparatus 10)

Figure 1:
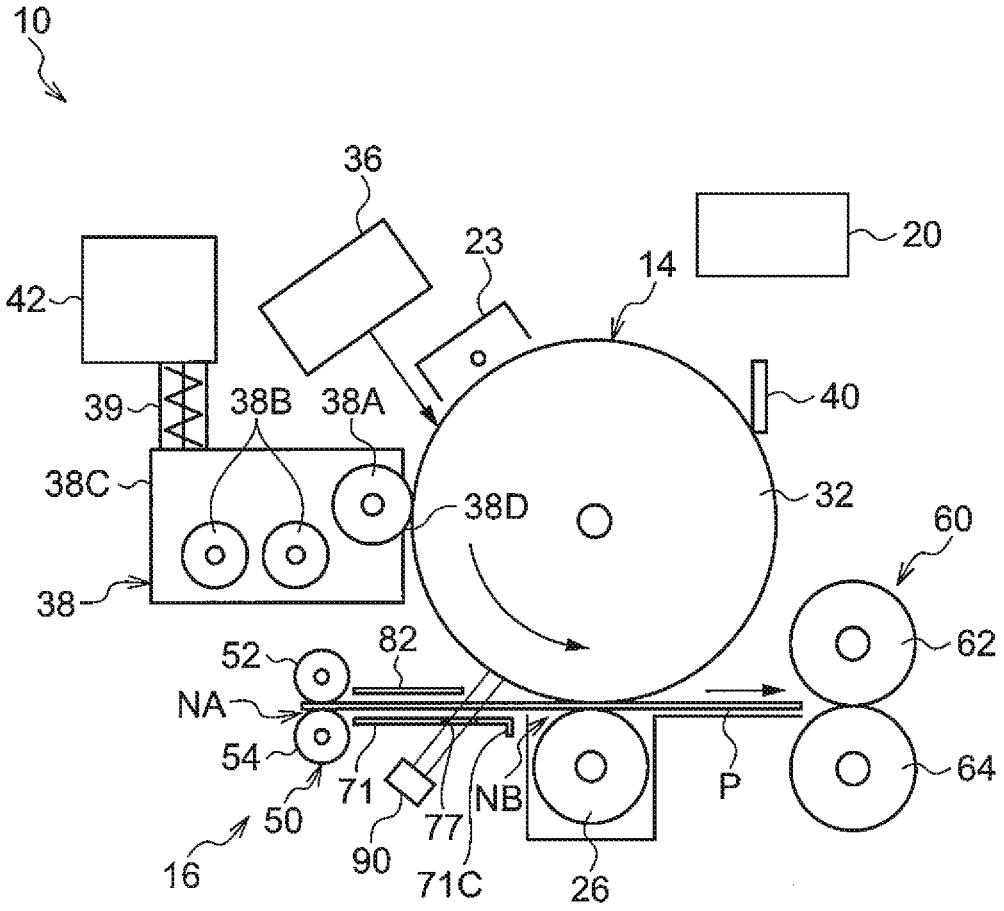
FIG. 1 is a schematic diagram illustrating the configuration of an image forming apparatus according to an exemplary embodiment of the present invention.

First, the configuration of an image forming apparatus 10 will be described. FIG. 1 is a schematic diagram illustrating the configuration of the image forming apparatus 10.

As illustrated in FIG. 1, the image forming apparatus 10 includes an image forming section 14 that forms an image on a sheet P (an example of a recording medium), a transport unit 16 that transports the sheet P to the image forming section 14, and a controller 20 that controls the operation of each unit of the image forming apparatus 10.

The image forming section 14 includes a photoconductor drum 32 (an example of an image carrier) that holds a toner image (an example of an image). The photoconductor drum 32 is configured to be driven so as to rotate in one direction (e.g., a counterclockwise direction in FIG. 1). In the vicinity of the photoconductor drum 32, a charging device 23 that charges the photoconductor drum 32, an exposure device 36 that exposes the photoconductor drum 32, which has been charged by the charging device 23, to light so as to form an electrostatic latent image (an example of a latent image) on the photoconductor drum 32, a developing device 38 that develops the electrostatic latent image, which has been formed on the photoconductor drum 32 by the exposure device 36, into a toner image, a transfer roller 26 that transfers the toner image, which has been formed on the photoconductor drum 32 by the developing device 38, onto the sheet P, and a removal member 40 that removes a toner that remains on the photoconductor drum 32 after the toner image has been transferred to the sheet P by the transfer roller 26 are disposed in this order starting from an upstream side in a rotation direction of the photoconductor drum 32.

The developing device 38 is disposed adjacent to the photoconductor drum 32 (on the left side in FIG. 1). The developing device 38 includes a housing 38C (device body), a developer supply body 38A, and plural transport members 38B. An opening 38D is formed in the housing 38C at a position facing the photoconductor drum 32 (on the left side in FIG. 1).

The developer supply body 38A is disposed in the opening 38D and supplies a developer to the photoconductor drum 32 at a predetermined developing position (a position facing the photoconductor drum 32). The plural transport members 38B transport the developer, which is to be supplied to the developer supply body 38A, while stirring the developer.

The image forming apparatus 10 further includes a toner cartridge 42 serving as a container that contains a toner to be supplied to the developing device 38, and a toner-supply mechanism 39 that supplies the toner in the toner cartridge 42 to the developing device 38 by transporting the toner to the developing device 38.

The exposure device 36 is configured to form an electrostatic latent image on the basis of an image signal that is transmitted from the controller 20. An example of the image signal that is transmitted from the controller 20 includes an image signal that is obtained from an external apparatus by the controller 20.

The transfer roller 26 is disposed below the photoconductor drum 32. The transfer roller 26 is in contact with the photoconductor drum 32 from below and is driven by the photoconductor drum 32 and rotates. The transfer roller 26 rotates together with the photoconductor drum 32 so as to transport the sheet P, which is nipped between the transfer roller 26 and the photoconductor drum 32 in a contact region NB (nip region) between the transfer roller 26 and the photoconductor drum 32, to the downstream side in a transport direction of the sheet P.

A transfer voltage (transfer current) having a polarity opposite to the polarity of the toner is applied to the transfer roller 26. As a result, a transfer electric field is generated between the photoconductor drum 32 and the transfer roller 26. Then, an electrostatic force acts on a toner image, which has been formed on and held by the photoconductor drum 32, in the contact region NB, and the toner image is transferred onto a target surface of the sheet P. Note that a first surface of the sheet P onto which a toner image is transferred will be referred to herein as a target surface, and a second surface (the other surface) of the sheet P that is opposite to the target surface will be referred to herein as a non-target surface.

The transport unit 16 includes a pair of transport rollers 50 that transport the sheet P to the contact region NB in the horizontal direction. The pair of transport rollers 50 include a driving roller 52 that is disposed on an upper side and a driven roller 54 that is disposed on a lower side. The driving roller 52 is driven by a driving unit (not illustrated) so as to rotate. The driven roller 54 is in contact with the driving roller 52 and is driven by the driving roller 52 and rotates.

The pair of transport rollers 50 nip the sheet P in a contact region NA between the driving roller 52 and the driven roller 54 and transports the sheet P to contact region NB. More specifically, the pair of transport rollers 50 transport the sheet P to the contact region NB at a predetermined timing in order to adjust the position of the sheet P (position of a leading end of the sheet P) and a transfer position (transfer start position) at which a toner image is transferred from the photoconductor drum 32 onto the sheet P with respect to each other.

A fixing device 60 that fixes a toner image, which has been transferred to the sheet P by the transfer roller 26, onto the sheet P is disposed at a position downstream from the contact region NB in the transport direction. The fixing device 60 includes a heating roller 62 and a pressure roller 64. In the fixing device 60, a toner image that has been transferred to the sheet P is fixed onto the sheet P as a result of being heated by the heating roller 62 and being pressurized by the pressure roller 64.

(Image Forming Operation)

An image forming operation for forming an image on the sheet P that is performed by the image forming apparatus 10 will now be described.

In the image forming apparatus 10, the sheet P is sent into the contact region NB by the pair of transport rollers 50. Meanwhile, in the image forming section 14, the photoconductor drum 32 is exposed to light by the exposure device 36 after being charged by the charging device 23, and an electrostatic latent image is formed on the photoconductor drum 32. The electrostatic latent image is developed by the developing device 38, and as a result, a toner image is formed on the photoconductor drum 32. The toner image is transferred onto the sheet P by the transfer roller 26 in the contact region NB. The sheet P, to which the toner image has been transferred, is transported to the fixing device 60, and the toner image is fixed onto the sheet P by the fixing device 60. A series of image forming operations is performed in the manner described above.

(Specific Configuration between Contact Region NA and Contact Region NB)

A specific configuration between the contact region NA and the contact region NB in the image forming apparatus 10 will now be described.

As illustrated in FIG. 1, the image forming apparatus 10 includes a first transport guide 71 (an example of a guiding member) that guides the non-target surface (bottom surface) of the sheet P, a second transport guide 82 that guides the target surface (top surface) of the sheet P, and a sensor 90 (an example of a sensing unit) that detects a toner image on an outer circumferential surface of the photoconductor drum 32.

The first transport guide 71, the second transport guide 82, and the sensor 90 are disposed between the contact region NA (the pair of transport rollers 50) and the contact region NB (the photoconductor drum 32 and the transfer roller 26). In other words, the first transport guide 71, the second transport guide 82, and the sensor 90 are positioned downstream from the contact region NA in the transport direction and upstream from the contact region NB in the transport direction.

The sensor 90 is disposed below the developing device 38 in the vertical direction. In addition, the sensor 90 is disposed below the contact region NA, the contact region NB, and a transport path of the sheet P. Furthermore, the sensor 90 is disposed at a position that corresponds to the center of the photoconductor drum 32 in the axial direction of the photoconductor drum 32 and to the center of the first transport guide 71 in the width direction of the first transport guide 71 (see FIG. 4).

Figure 2:
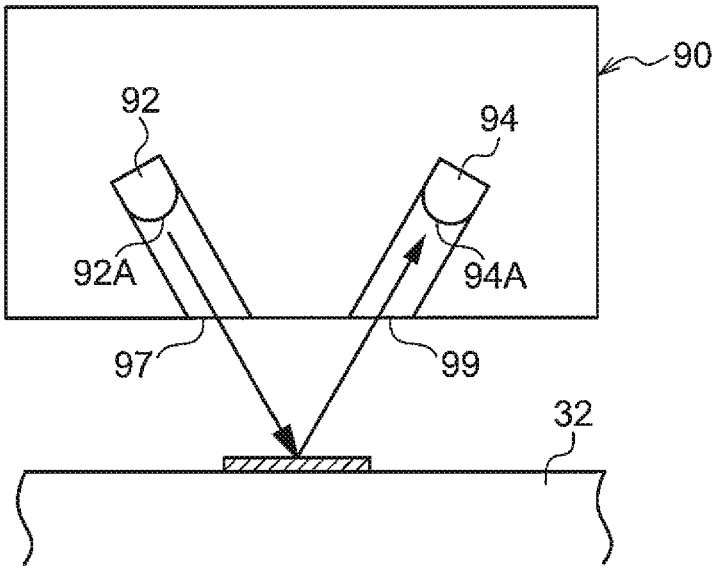
FIG. 2 is a schematic diagram illustrating the configuration of a sensor according to the exemplary embodiment.

The sensor 90 is a light-reflection-type sensor that detects a toner image. More specifically, as illustrated in FIG. 2, the sensor 90 includes a light-radiation unit 92 (light-emitting unit) that radiates irradiation light from a radiation surface 92A and a light-receiving unit 94 that receives reflected light, which corresponds to the irradiation light that has been reflected by the photoconductor drum 32, by using a light-receiving surface 94A. For example, a light-emitting diode (LED) is used as the light-radiation unit 92, and for example, a photodiode (PD) is used as the light-receiving unit 94.

The sensor 90 further includes a light-emission window 97 from which the irradiation light of the light-radiation unit 92 is emitted and a light-incident window 99 through which the reflected light is incident on the light-receiving unit 94. Each of the light-emission window 97 and the light-incident window 99 is formed of a transparent member that allows light to pass therethrough.

In a state where the sheet P is not passing between the first transport guide 71 and the second transport guide 82, the sensor 90 detects, in an optical path that extends through a through hole 77 (described later) of the first transport guide 71, an image on the outer circumferential surface of the photoconductor drum 32. In other words, in the sensor 90, the irradiation light radiated from the light-radiation unit 92 passes through the through hole 77 and is incident on a portion of the outer circumferential surface of the photoconductor drum 32, the portion extending between the developing position and the contact region NB, and the reflected light corresponding to the irradiation light that has been reflected by the outer circumferential surface passes through the through hole 77 and is incident on the light-receiving unit 94.

A toner image that is to be detected by the sensor 90 is a non-transfer image that is formed separately from an image to be transferred onto the sheet P and is, for example, a toner patch that is formed on the photoconductor drum 32 so as to be detected by the sensor 90 and that will not be transferred onto the sheet P.

The toner patch is formed on the photoconductor drum 32 at a predetermined timing and is detected by the sensor 90. Examples of the predetermined timing include the timing at which the image forming apparatus 10 is switched on, the timing between a job (processing unit of an image forming operation to be processed (performed) as a result of the controller 20 receiving an image formation command) and another job, and the timing at which an image forming operation for forming a transfer image has been completed.

Figure 3:
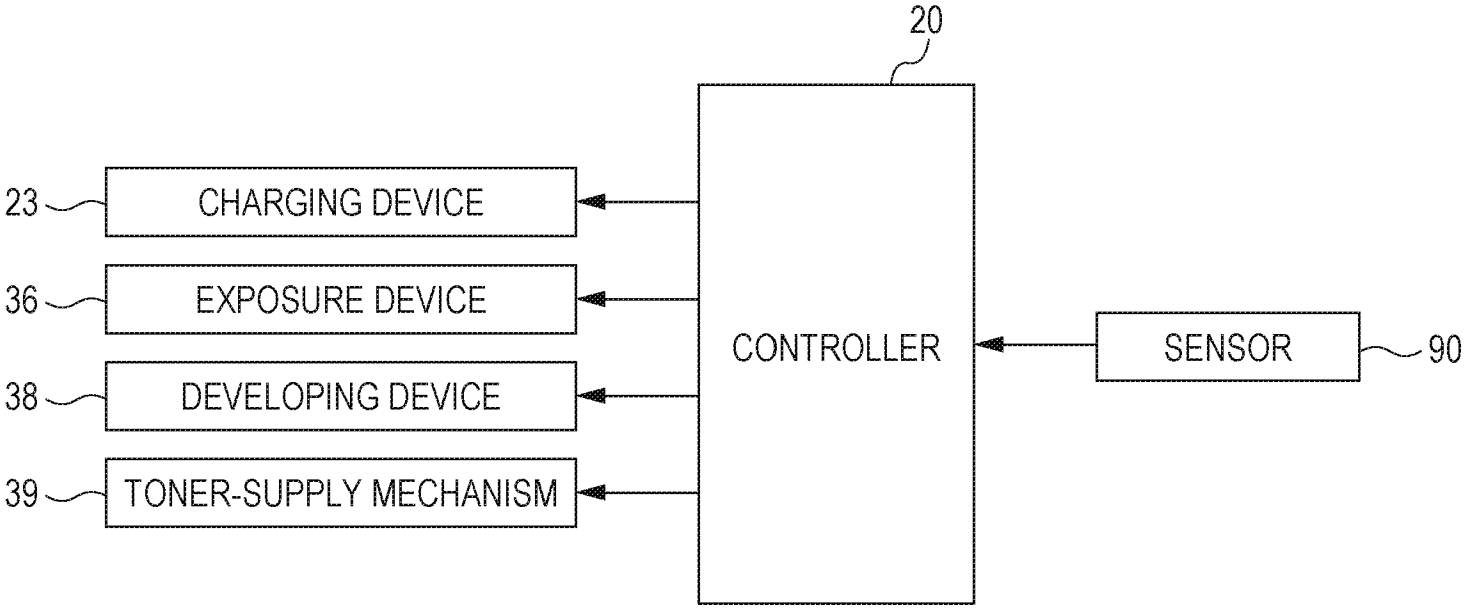
FIG. 3 is a block diagram illustrating a control system of the image forming apparatus according to the exemplary embodiment.

In the present exemplary embodiment, the sensor 90 detects the toner patch and an original surface of the photoconductor drum 32 on which a toner image is not formed. As illustrated in FIG. 3, the sensor 90 is connected to the controller 20, and detection results obtained by the sensor 90 are transmitted to the controller 20. Each of the units (particularly the charging device 23, the exposure device 36, the developing device 38, and the toner-supply mechanism 39) of the image forming section 14 is connected to the controller 20. The controller 20 controls each of the units of the image forming section 14 on the basis of the detection results obtained by the sensor 90. The specific control of the controller 20 will be described later.

As illustrated in FIG. 1, the second transport guide 82 is positioned above the sensor 90 and below the developing device 38. In addition, the second transport guide 82 is positioned above the contact region NA and the contact region NB in a height direction and guides the top surface of the sheet P that is transported between the developing device 38 and the sensor 90.

Furthermore, the second transport guide 82 is disposed at a position that is between the driving roller 52 and the photoconductor drum 32 and that is upstream from the optical path of the sensor 90 in the transport direction (on the left side in FIG. 1). As described above, the second transport guide 82 is arranged in such a manner as to ensure a space on the optical path of the sensor 90. The second transport guide 82 is in the form of a plate having a predetermined width in the axial directions of the photoconductor drum 32 and the transfer roller 26.

The first transport guide 71 is positioned above the sensor 90 and below the developing device 38. In addition, the first transport guide 71 is positioned below the contact region NA and the contact region NB in the height direction and guides the bottom surface of the sheet P that is transported between the developing device 38 and the sensor 90. Furthermore, the first transport guide 71 is disposed at a position that is between the driven roller 54 and the transfer roller 26 and that is on the optical path of the sensor 90 when viewed from the side.

The first transport guide 71 is in the form of a plate having a predetermined width in the axial directions of the photoconductor drum 32 and the transfer roller 26. A bent portion 71C that is bent downward is formed in a downstream end portion of the first transport guide 71 in the transport direction.

Figure 4:
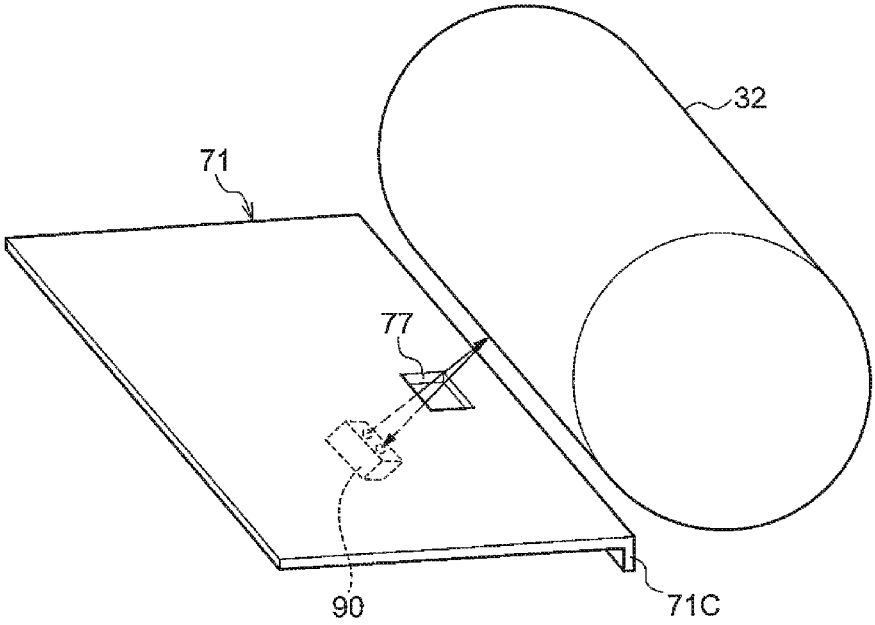
FIG. 4 is a schematic perspective view illustrating the configurations of the sensor and a first transport guide according to the exemplary embodiment.

As illustrated in FIG. 4 and FIG. 1, the through hole 77 (an example of a cutout portion) extending through the first transport guide 71 in the thickness direction of the first transport guide 71 (top-bottom direction) is formed in a center portion of the first transport guide 71 in the width direction of the first transport guide 71. The through hole 77 is formed in a downstream portion of the first transport guide 71 in the transport direction (at a position closer to the downstream end of the first transport guide 71 than the upstream end of the first transport guide 71 in the transport direction).

Figure 5:
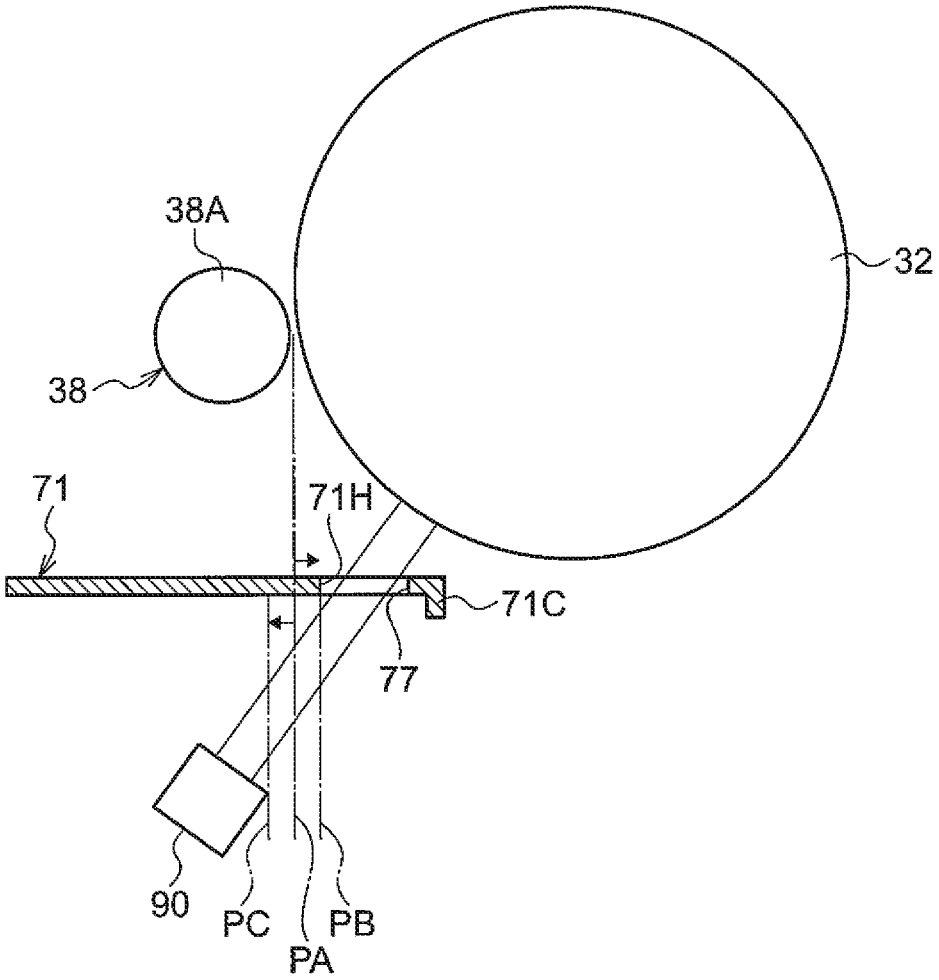
FIG. 5 is a schematic diagram illustrating the configurations of a developing device (developer supply body), the first transport guide, and the sensor according to the exemplary embodiment.

The first transport guide 71 covers the upper side of the sensor 90 in the vertical direction in a state where the through hole 77 ensures a space on the optical path of the sensor 90. More specifically, as illustrated in FIG. 5, it is desirable that the positional relationship between the developing device 38, the first transport guide 71, and the sensor 90 in the transport direction be as follows. That is to say, it is desirable that a position PB of a downstream end surface 71H of a portion of the first transport guide 71 in the transport direction, the portion covering the sensor 90, (an upstream edge of the through hole 77 in the transport direction) be further toward the downstream side (the right side) than a position PA of a surface (the right end) of the developer supply body 38A, which is included in the developing device 38, the surface facing the photoconductor drum 32, in the transport direction. It is desirable that a position PC of a downstream end of the sensor 90 in the transport direction be further toward the upstream side (the left side) than the above-mentioned position PA in the transport direction.

Note that if the above-mentioned position PC is at least further toward the upstream side (the left side) than the above-mentioned position PB in the transport direction, the first transport guide 71 may cover the upper side of the sensor 90 in the vertical direction in a state where a space is ensured on the optical path of the sensor 90.

The position of the developer supply body 38A functions as a reference position in the developing device 38 because it is assumed that the developer will fall from the developer supply body 38A. Note that, for example, when it is assumed that the developer will fall through the opening 38D (see FIG. 1) of the housing 38C (device body) of the developing device 38, the position of the opening 38D may be set so as to function as a reference position.

(Operation According to Exemplary Embodiment)

Operation according to the present exemplary embodiment will now be described.

In the present exemplary embodiment, in a state where the sheet P is not passing between the first transport guide 71 and the second transport guide 82, the sensor 90 detects the toner patch on the photoconductor drum 32 and the original surface of the photoconductor drum 32. Detection results related to the toner patch and the original surface, which have been detected by the sensor 90, are transmitted to the controller 20 as an original-surface output value and a patch output value. The controller 20 controls each of the units of the image forming section 14 on the basis of the difference between an image density value, which is the ratio of the patch output value to the original-surface output value, and a target density value. More specifically, the controller 20 controls, on the basis of the difference between the image density value and the target density value, the charge potential of the charging device 23, the light exposure of the exposure device 36, the developing potential of the developing device 38, the amount of toner supplied to the developing device 38, and the like. As a result, the density of a toner image that is formed on the photoconductor drum 32 may be kept constant.

In addition, the controller 20 may determine, on the basis of the difference between the image density value and the target density value, whether there is no toner in the toner cartridge 42, that is, the toner cartridge 42 is in an empty state.

(Modifications)

Figure 6A:
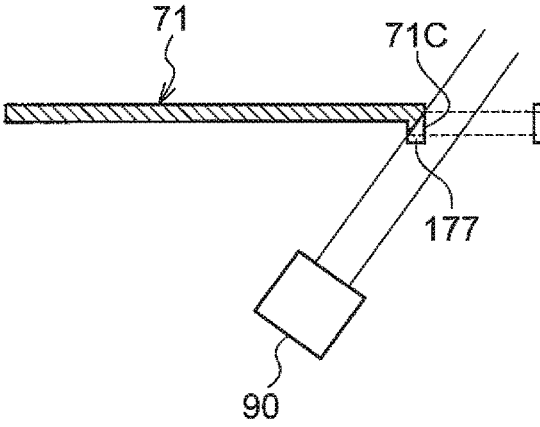
FIGS. 6A and 6B are schematic diagrams illustrating the configuration of a first transport guide according to a modification.
Figure 6B:
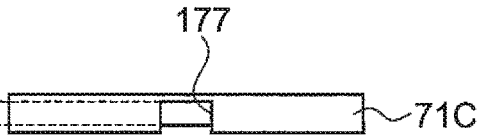

Although, in the present exemplary embodiment, the through hole 77 is formed in the first transport guide 71 as an example of a cutout portion, the cutout portion is not limited to the through hole 77. An example of the cutout portion may be the cutout portion 177 that is formed in the bent portion 71C as illustrated in FIG. 6. FIG. 6A is a sectional side view of the first transport guide 71, and FIG. 6B is a diagram illustrating the first transport guide 71 when viewed from the downstream side in the transport direction.

Here, in a configuration (a comparative example) in which a cutout portion is formed in a horizontal portion (portion that guides the sheet P) of the first transport guide 71, the sheet P will not rub against the first transport guide 71 in the cutout portion, and thus, when the sheet P is electrically charged as a result of rubbing against the first transport guide 71, variations in the frictional electrification amount in the width direction of the sheet P may sometimes occur. When variations in the frictional electrification amount in the width direction of the sheet P occur, variations in the transferability of a toner image in the width direction of the sheet P occur.

In contrast, in the configuration illustrated in FIG. 6, a cutout portion 177 is formed in the bent portion 71C with which a trailing end of the sheet P is brought into contact, and the sheet P is less likely to be triboelectrically-charged as a result of making contact with the bent portion 71C compared with the comparative example. Thus, it is not likely that variations in the frictional electrification amount will occur.

Although the transfer roller 26 is used as a transfer body in the present exemplary embodiment, the transfer body is not limited to the transfer roller 26. A transfer belt may be used as the transfer body.

The present invention is not limited to the above-described embodiment, and various modifications, changes, and improvements may be made within the gist of the present application. For example, the above-described modifications may be suitably combined together.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier configured to hold an image formed by developing a latent image and which is to be transferred onto a recording medium;

a developing device disposed adjacent to the image carrier and that is configured to develop the latent image;

a light-reflection-type sensor disposed below the developing device in a vertical direction and that is configured to detect the image on the image carrier; and a guiding member configured to guide the recording medium, which is transported between the developing device and the sensor, and that covers an upper side of the sensor in the vertical direction in a state where a space is ensured on an optical path of the sensor, wherein the guiding member has a cutout portion that ensures the space on the optical path of the sensor, and wherein a downstream-most end of the sensor in a transport direction is located on an upstream side of an upstream-most edge of the cutout portion in the transport direction.

2. The image forming apparatus according to claim 1, wherein the guiding member completely covers the sensor in the vertical direction.

3. The image forming apparatus according to claim 1, wherein the guiding member is configured to block developer that may fall from the developing device.

4. The image forming apparatus according to claim 1, wherein a downstream-most end of the developing device in the transport direction is located at the upstream side of the upstream-most edge of the cutout portion in the transport direction.

5. The image forming apparatus according to claim 1, wherein the guiding member comprises a through hole that ensures the space on the optical path of the sensor.

6. An image forming apparatus comprising:

an image carrier configured to hold an image formed by developing a latent image and which is to be transferred onto a recording medium;

a developing device disposed adjacent to the image carrier and that is configured to develop the latent image;

a light-reflection-type sensor disposed below the developing device in a vertical direction and that is configured to detect the image on the image carrier; and a guiding member configured to guide the recording medium, which is transported between the developing device and the sensor, and that covers an upper side of the sensor in the vertical direction in a state where a space is ensured on an optical path of the sensor, wherein the guiding member has a cutout portion that ensures the space on the optical path of the sensor, and wherein a downstream-most end of the developing device in the transport direction is located at the upstream side of the upstream-most edge of the cutout portion in the transport direction.

7. The image forming apparatus according to claim 6, wherein a downstream-most end of the sensor in the transport direction is located on the upstream side of an upstream-most edge of the cutout portion in the transport direction.

8. The image forming apparatus according to claim 6, wherein the guiding member completely covers the sensor in the vertical direction.

9. The image forming apparatus according to claim 6, wherein the guiding member covers the sensor in the vertical direction such that all vertical lines extending parallel to the vertical direction from the sensor pass through the guiding member.

10. The image forming apparatus according to claim 6, wherein the guiding member is configured to block developer that may fall from the developing device.

11. The image forming apparatus according to claim 6, wherein the guiding member comprises a through hole that ensures the space on the optical path of the sensor.

12. An image forming apparatus comprising:

an image carrier configured to hold an image formed by developing a latent image and which is to be transferred onto a recording medium;

a developing device disposed adjacent to the image carrier and that is configured to develop the latent image;

a light-reflection-type sensor disposed below the developing device in a vertical direction and that is configured to detect the image on the image carrier;

a first guiding member configured to guide the recording medium, which is transported between the developing device and the sensor, and that covers an upper side of the sensor in the vertical direction in a state where a space is ensured on an optical path of the sensor; and a second guiding member, wherein the first guiding member comprises a through hole that ensures the space on the optical path of the sensor, and wherein the second guiding member is arranged so that the optical path of the sensor is on a downstream side of the second guiding member in the transport direction.

13. The image forming apparatus according to claim 12, wherein a downstream-most end of the second guiding member in the transport direction is located on a downstream side of an upstream-most end of the through hole.

14. The image forming apparatus according to claim 13, wherein a downstream-most end of the sensor in a transport direction is located on an upstream side of an upstream-most edge of the cutout portion in the transport direction.

15. The image forming apparatus according to claim 14, wherein a downstream-most end of the developing device in the transport direction is located at the upstream side of the upstream-most edge of the cutout portion in the transport direction.

* * * * *